United States Patent [19]

Ball

[11] Patent Number: 4,773,337

[45] Date of Patent: Sep. 27, 1988

[54] TILT TOP TABLE HARDWARE

[75] Inventor: Richard I. Ball, Round Lake, Ill.

[73] Assignee: Johnson Industries, Elgin, Ill.

[21] Appl. No.: 513,628

[22] Filed: Jul. 14, 1983

[51] Int. Cl.[4] ..... H47B 3/00

[52] U.S. Cl. ..... 108/124; 108/150; 108/153

[58] Field of Search ..... 16/260–262, 16/386, 268, 254; 108/153, 150, 124, 6; 70/159–163; 248/222.2, 235, 240.3, 240.4, 240, 293

[56] References Cited

U.S. PATENT DOCUMENTS

| | | | |
|---|---|---|---|
| 367,616 | 8/1887 | Gray | 16/268 |
| 958,746 | 5/1910 | Johnson | 248/240.3 |
| 1,117,248 | 11/1914 | Rosen | 248/222.2 |
| 1,589,507 | 6/1926 | Bond | 16/268 |
| 2,021,464 | 11/1935 | Rickard et al. | 108/153 |
| 2,722,034 | 11/1955 | May | 16/268 |
| 3,993,004 | 11/1976 | Alme | 108/150 |
| 4,079,498 | 3/1978 | Belvins | 16/260 |

*Primary Examiner*—Joseph Falk

*Attorney, Agent, or Firm*—Edmond T. Patnaude

[57] ABSTRACT

Mating hinge parts are respectively attached to the top of a pedestal and to the bottom of a table top to permit the top to rest in a substantially upright, yet stable position, the hinge parts also being readliy separable to permit facile removal of the table top from the pedestal.

4 Claims, 1 Drawing Sheet

TILT TOP TABLE HARDWARE

The present invention relates in general to tables of the type having a top which is pivotably and removably attached to the base, and it relates in particular to a new and improved table which is stronger and more durable than those which were heretofore known the in prior art.

BACKGROUND OF THE INVENTION

In U.S. Pat. No. 3,993,004 there is described a table having a top which is pivotally attached to the base so as to be tiltable into a substantially vertical, stable position for compact storage when the table is not in use. The mechanism which is used to mount the table top to the base is relatively heavy and expensive to manufacture although it functions satisfactorily.

SUMMARY OF THE INVENTION

Briefly, there is provided in accordance with the present invention a new and improved table having a top which may be swung between a horizontal position of use and a substantially upright storage position. A first horizontal plate member is affixed to the top of a pedestal or other table base and has a plurality of aligned slots near one edge which respectively receive an equal number of reversely bent lugs which extend from the associated edge of a second horizontal plate member which is affixed to the bottom of a table-top. With the table top in the horizontal position of use, the second plate rests directly on the first plate, and interlocking latch pieces on the two plates are engaged to prevent spurious tilting of the table top relative to the base.

After releasing the latch, the top can be tilted to a stable, almost vertical position, and offturned end portions of the lugs abut the bottom of the first plate to limit the angle of tilt.

The table top can be easily removed from the base by swinging it about sixty degrees from the horizontal position and lifting the lugs out of the slots in the first plate.

GENERAL DESCRIPTION OF THE DRAWING

The present invention will be better understood by a reading of the following detailed description taken in connection with the accompanying drawing wherein.

DETAILED DESCRIPTION OF A PREFERRED EMBODIMENT OF THE INVENTION

Figure 1:
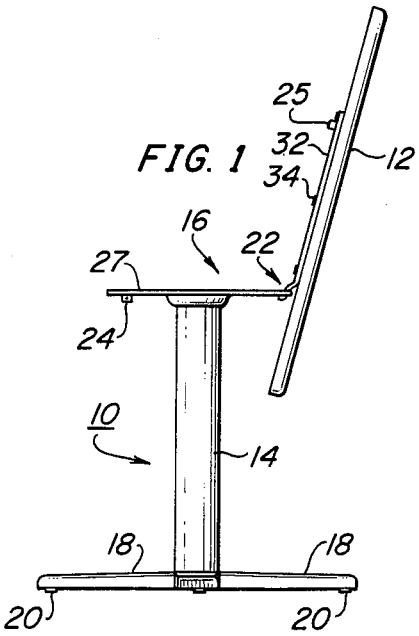
FIG. 1 is an elevational view of a pedestal type table embodying the present invention, the table top being shown in a tilted, storage position.

Referring particularly to FIG. 1, a table 10 includes a table top 12 mounted to the top of a pedestal base 14 by a tilt mechanism 16 which is attached to the bottom side of the table top 12 and to the top of the pedestal 14. A plurality of legs 18 extend from the bottom of the pedestal and are each provided with glide or foot 20. A tilt mechanism 16 includes hinge means 22 which enables the top 12 to be swung from a horizontal position of normal use to the upstanding storage position as shown in FIG. 1. The table top 12 is held by the force of gravity in the illustrated tilted position as well as in the horizontal position of use. Inadvertent tilting of the table from the horizontal position is prevented by a latch mechanism including interengaging parts 24 and 25. Moreover, the table top 12 can be readily removed from the base when desired.

Figure 2:
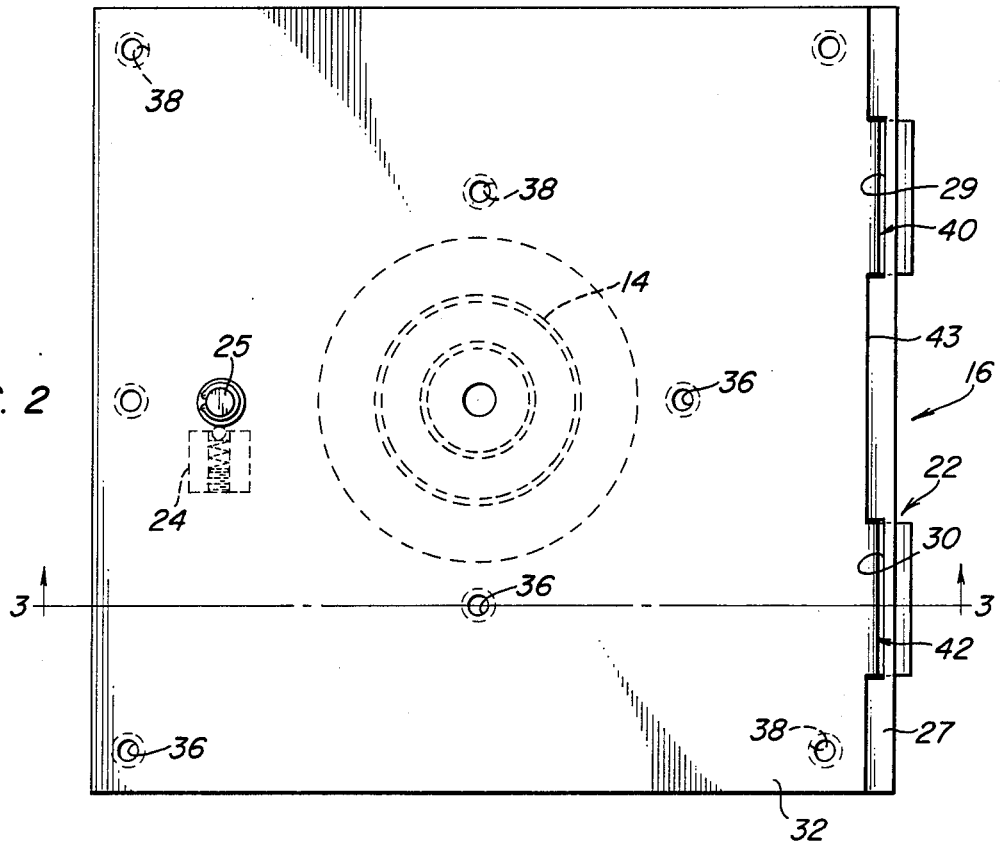
FIG. 2 is a top plan view of the hardware used in mounting the top to the base of the table shown in FIG. 1, the hardware being shown in the horizontal position of use.
Figure 3:
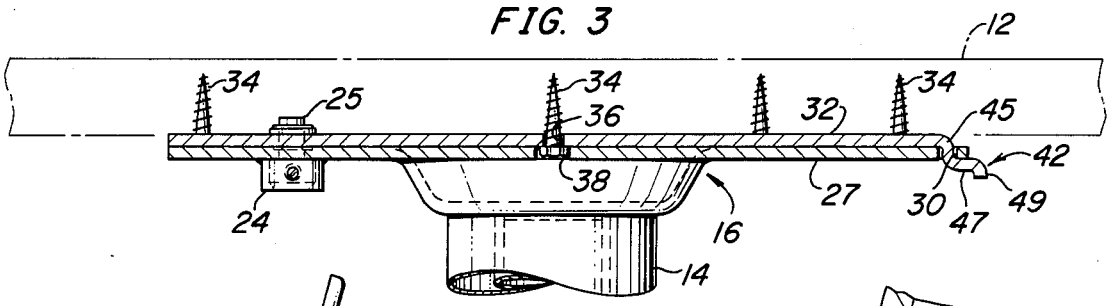
FIG. 3 is a cross-sectional view taken along the line 3—3 of FIG. 2.

As best shown in FIGS. 2 and 3, the tilt mechanism 16 includes a first plate member 27 which is rigidly secured in any suitable manner to the top of the pedestal 14 with the top surface of the plate member 27 being perpendicular to the longitudinal axis of the pedestal. In the illustrated embodiment of the invention the central portion of the plate member 27 is depressed. The plate member is generally square and has a plurality of aligned slots 29 and 30. A second plate member 32 is fixedly mounted against the bottom side of the top 12 by means of a plurality of lag bolts 34 which extend through mounting holes 36 in the plate 32. It may be seen that the lower plate member 27 is provided with a plurality of holes 38 into which the heads of the bolts 34 extend when the bottom side of the plate 32 is resting directly on the top side of the plate 27.

The plate 32 is hingedly attached to the plate 27 by means of a plurality of lugs or tongues 40 and 42 which are adapted to extend respectively through the slots 29 and 30. The tongues 40 and 42, extend from one edge 43 of the plate 32, are identical, and therefore, only the tongue 42 is described in detail herein and may be seen to include a reversely bent or curved section which prevents the plates from sliding relative to one another when the table top is in the horizontal position of use. More particularly, the tongue 42 has a depending section 45 and an adjacent section 47 which extends parallel to the bottom side of the plate 32. The top of the section 47 is spaced from the plane of the bottom side of the plate 32 by a distance about equal to but no less than the thickness of the plate 32 whereby the top of the tongue section 47 abuts the bottom side of the lower plate 27 when the table top 12 is in the horizontal position of use.

Figure 4:
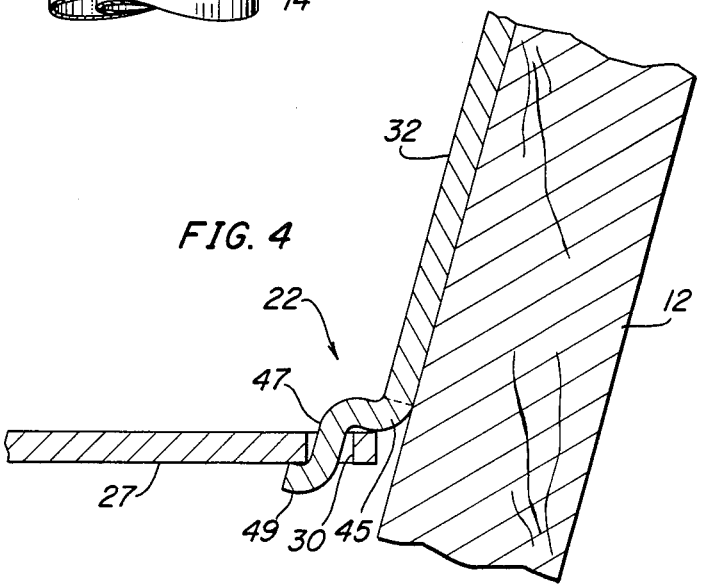
FIG. 4 is an enlarged view of one of the hinges used on the hardware of FIG. 3, the hinge being shown in the table top storage position.

As the table top 12 is swung from the position shown in FIG. 3 to the tilted storage position shown in FIG. 4, the tongue section 47 moves up into the slot 30 and the section 45 moves over the top surface of the lower plate 27 until it reaches the position shown in FIG. 4 wherein it rests directly on the plate 27.

In order to prevent spurious removal of the table top 12 from the base, the distal end portion 49 is offturned and extends along the bottom side of the lower plate 27 into abutting relationship therewith. The center of gravity of the table top 12 is outside the pivot axis of the hinges and thus stabilizes the storage position of the table top.

The latch which locks the top in the horizontal position of use is preferably of the spring loaded detent type which permits the top to be tilted from the horizontal position of use by simply lifting the edge of the table top opposite the edge 43 from which the tongues extend. However, any other suitable latch or locking mechanism may be used if desired.

When it is desired to remove the table top 12 from the base, it is only necessary to tilt the top to an angular position of about sixty degrees relative to the plate of the lower plate 27 and then to lift the tongues 40 and 42 out of the slots 29 and 30. The top can be assembled to the base by positioning the distal ends of the tongues 40 and 42 over the slots 29 and 30 and then lowering the tongues through the slots while the top is in the sixty degree position.

It may thus be seen that the tilt top mechanism of the present invention is simple to use and does not require the user to place his hands under the table or in proximity to the hinge or locking mechanism. Moreover, the mechanism is relatively simple and thus inexpensive to manufacture and to assemble to the table with which it is to be used.

While the present invention has been described in connection with a particular embodiment thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. In a table of the type having a table top supported on a table base, the combination comprising a first member fixedly secured to the top of said table base, said first member having a planar top surface, and a bottom surface, a second member fixedly secured to the bottom of said table top and adapted to rest, when in a horizontal position, on said first member with the bottom surface of said second member in juxtaposition with the top surface of said first member, at least one elongated slot in said first member, at least one tongue extending from one edge of said second member and dimensioned to extend through said slot, a first section of said tongue depending through said slot when said second member is in a horizontal position resting on said first member, a second section of said tongue adjacent to said first section and extending laterally from said first section in proximity with said bottom surface of said first member when said second member is in said horizontal position resting on said first member, a third section of said tongue adjacent to said second section and extending laterally from said second section, when said second member is tilted from the horizontal through an angle greater than ninety degrees said first section rests on said top surface of said first member, said second section depends through said slot and said third section extends beneath and in abutment with said bottom surface of said first member.

2. The combination according to claim 1 wherein said tongue is S-shaped in cross-section.

3. The combination according to claim 1 comprising interengaging latch means on said first and second members for latching said members together when said second member is in said horizontal position.

4. The combination according to claim 1 wherein said first section has a length at least as great as the thickness of said first member.

* * * * *